US010105983B2

(12) United States Patent
Steele et al.

(10) Patent No.: US 10,105,983 B2
(45) **Date of Patent: *Oct. 23, 2018**

(54) MARKING PEN

(71) Applicant: Milwaukee Electric Tool Corporation, Brookfield, WI (US)

(72) Inventors: Michael S. Steele, Pewaukee, WI (US); Steven W. Hyma, Milwaukee, WI (US); Wade F. Burch, Wauwatosa, WI (US); Abhijeet A. Khangar, Pewaukee, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 18 days.

This patent is subject to a terminal disclaimer.

(21) Appl. No.: 15/195,014

(22) Filed: Jun. 28, 2016

(65) Prior Publication Data

US 2016/0303891 A1 Oct. 20, 2016

Related U.S. Application Data

(63) Continuation of application No. 13/910,707, filed on Jun. 5, 2013, now Pat. No. 9,403,399.

(Continued)

(51) Int. Cl.

| | |
|---|---|
| ***B43K 29/00*** | (2006.01) |
| ***B43K 23/12*** | (2006.01) |
| ***B43K 25/02*** | (2006.01) |

(52) U.S. Cl.

CPC ..... *B43K 29/00* (2013.01); *B43K 23/126* (2013.01); *B43K 25/022* (2013.01)

(58) Field of Classification Search

CPC combination set(s) only.

See application file for complete search history.

(56) References Cited

U.S. PATENT DOCUMENTS

| | | | |
|---|---|---|---|
| 385,448 | A | 7/1888 | Disney |
| 863,915 | A | 8/1907 | Graves |

(Continued)

FOREIGN PATENT DOCUMENTS

| | | |
|---|---|---|
| CN | 201122283 | 9/2008 |
| JP | H07311652 | 11/1995 |

(Continued)

OTHER PUBLICATIONS

Brookstone, "Tablet Pen for Touch Screen Devices," <http://www.brookstone.com/tablet-pen?bkiid=SearchResults|CategoryProductList|743729p> publicly available before Jun. 6, 2012.

(Continued)

*Primary Examiner* — David Walczak

(74) *Attorney, Agent, or Firm* — Reinhart Boerner Van Deuren s.c.

(57) ABSTRACT

A marking pen including a body having a first end, a second end, a longitudinal axis that extends centrally through the body and through the first end and the second end, and a pen adjacent the first end. The body is generally cylindrical from the first end to the second end. The marking pen further includes a fin that extends from the body between the first end and the second end. The fin is integrally formed with the body and has a height measured normal to the longitudinal axis. The height of the fin gradually increases in a direction from the second end toward the first end.

13 Claims, 5 Drawing Sheets

Related U.S. Application Data

(60) Provisional application No. 61/656,105, filed on Jun. 6, 2012.

(56) References Cited

U.S. PATENT DOCUMENTS

| | | | | |
|---|---|---|---|---|
| 948,802 | A | 2/1910 | Valkenburg | |
| 986,890 | A | 3/1911 | Archibald | |
| RE13,596 | E | 7/1913 | Van Valkenburg | |
| 1,223,360 | A | 4/1917 | Berners | |
| 1,344,897 | A | 6/1920 | Johnson | |
| 1,834,151 | A | 4/1930 | Gordon | |
| 2,102,044 | A | 12/1937 | Sypher | |
| 2,513,516 | A | 7/1950 | Randle | |
| 4,071,689 | A | 1/1978 | Talmage et al. | |
| 4,285,101 | A | 8/1981 | Hanna | |
| 4,644,101 | A | 2/1987 | Jin et al. | |
| 4,765,767 | A | 8/1988 | Marynissen et al. | |
| 5,004,872 | A | 4/1991 | Lasley | |
| 5,153,572 | A | 10/1992 | Caldwell et al. | |
| 5,440,080 | A | 8/1995 | Nagaoka et al. | |
| 5,488,204 | A | 1/1996 | Mead et al. | |
| 5,581,484 | A | 12/1996 | Prince | |
| 5,747,748 | A | 5/1998 | Zigler | |
| 5,877,459 | A | 3/1999 | Prater | |
| 5,897,264 | A | 4/1999 | Baudino | |
| 5,913,629 | A | 6/1999 | Hazzard | |
| 5,914,708 | A | 6/1999 | LaGrange et al. | |
| 6,050,735 | A | 4/2000 | Hazzard | |
| 6,227,743 | B1 | 5/2001 | Robb | |
| 6,275,193 | B1 | 8/2001 | Nilsen et al. | |
| 6,361,232 | B1 | 3/2002 | Nagaoka et al. | |
| 6,384,814 | B1 | 5/2002 | Kobayashi et al. | |
| 6,406,205 | B1 | 6/2002 | Hu | |
| 6,412,998 | B1 | 6/2002 | Ham | |
| 6,450,721 | B1 | 9/2002 | D'Amico et al. | |
| 6,633,282 | B1 | 10/2003 | Monroe | |
| 6,647,145 | B1 | 11/2003 | Gay | |
| 6,659,673 | B1 | 12/2003 | Haffner et al. | |
| 6,702,500 | B1 | 3/2004 | Haffner et al. | |
| 6,707,451 | B1 | 3/2004 | Nagaoka | |
| 6,738,050 | B2 | 5/2004 | Comiskey et al. | |
| 6,749,354 | B2 | 6/2004 | Kageyama et al. | |
| 6,771,254 | B2 | 8/2004 | An et al. | |
| 6,830,404 | B2 * | 12/2004 | Nagaoka | G06F 1/1626 345/179 |
| 6,894,683 | B2 | 5/2005 | Clapper et al. | |
| 6,972,754 | B2 | 12/2005 | Zank | |
| 6,979,143 | B2 * | 12/2005 | Goldberg | B43K 23/12 401/131 |
| 6,999,067 | B2 | 2/2006 | Chao et al. | |
| 7,008,131 | B2 | 3/2006 | Kagevarna et al. | |
| 7,018,122 | B2 | 3/2006 | Kwan et al. | |
| 7,018,124 | B1 | 3/2006 | Kageyama et al. | |
| D523,083 | S | 6/2006 | Furlong et al. | |
| 7,135,507 | B2 | 11/2006 | Sexton | |
| 7,172,359 | B2 | 2/2007 | Möck | |
| 7,377,708 | B2 | 5/2008 | Hageman et al. | |
| 7,416,359 | B2 | 8/2008 | Fred | |
| 7,448,817 | B2 | 11/2008 | Lin | |
| 7,607,849 | B2 | 10/2009 | Barker | |
| D604,363 | S | 11/2009 | Sunich et al. | |
| 7,683,895 | B2 | 3/2010 | Mika | |
| 7,981,210 | B2 | 7/2011 | Kwan et al. | |
| 8,125,469 | B2 | 2/2012 | Badaye et al. | |
| 8,130,213 | B2 | 3/2012 | No et al. | |
| 8,243,050 | B2 | 8/2012 | Adkiins | |
| 2003/0132923 | A1 | 7/2003 | Hu | |
| 2004/0150632 | A1 | 8/2004 | Clapper | |
| 2005/0156912 | A1 | 7/2005 | Taylor et al. | |
| 2005/0226675 | A1 | 10/2005 | Kwan et al. | |
| 2006/0165470 | A1 | 7/2006 | Gerules | |
| 2006/0222449 | A1 | 10/2006 | Cetera | |
| 2006/0239761 | A1 | 10/2006 | Cetera | |
| 2008/0030486 | A1 | 2/2008 | Cook | |
| 2008/0106521 | A1 | 5/2008 | Nave | |
| 2008/0252621 | A1 | 10/2008 | Shipton | |
| 2008/0266267 | A1 | 10/2008 | Chang | |
| 2008/0297491 | A1 | 12/2008 | Adkins | |
| 2009/0025602 | A1 | 1/2009 | Kwan et al. | |
| 2009/0078478 | A1 | 3/2009 | Newman | |
| 2009/0256824 | A1 | 10/2009 | Hainzl et al. | |
| 2009/0273588 | A1 | 11/2009 | King et al. | |
| 2009/0322685 | A1 | 12/2009 | Lee | |
| 2010/0170726 | A1 | 7/2010 | Yeh et al. | |
| 2010/0214251 | A1 | 8/2010 | Wu | |
| 2010/0225614 | A1 | 9/2010 | Sung | |
| 2010/0315384 | A1 | 12/2010 | Hargreaves et al. | |
| 2011/0304577 | A1 | 12/2011 | Brown et al. | |
| 2012/0039662 | A1 | 2/2012 | Zhang et al. | |
| 2012/0044214 | A1 | 2/2012 | Mori | |
| 2012/0050207 | A1 | 3/2012 | Westhues et al. | |
| 2012/0050231 | A1 | 3/2012 | Westhues et al. | |
| 2012/0086664 | A1 | 4/2012 | Leto | |
| 2012/0105361 | A1 | 5/2012 | Kremin et al. | |
| 2012/0105362 | A1 | 5/2012 | Kremin et al. | |
| 2012/0139879 | A1 | 6/2012 | Kim et al. | |
| 2012/0146957 | A1 | 6/2012 | Dunagan | |
| 2012/0146960 | A1 | 6/2012 | Shih et al. | |
| 2012/0162146 | A1 | 6/2012 | Jiang et al. | |
| 2012/0162148 | A1 | 6/2012 | Jiang et al. | |
| 2012/0162149 | A1 | 6/2012 | Jiang et al. | |
| 2012/0162150 | A1 | 6/2012 | Jiang et al. | |
| 2012/0162151 | A1 | 6/2012 | Jiang et al. | |
| 2012/0162152 | A1 | 6/2012 | Jiang et al. | |
| 2012/0162153 | A1 | 6/2012 | Jiang et al. | |
| 2012/0162154 | A1 | 6/2012 | Jiang et al. | |
| 2012/0162155 | A1 | 6/2012 | Jiang et al. | |
| 2012/0194484 | A1 | 8/2012 | Lehman | |

FOREIGN PATENT DOCUMENTS

| | | |
|---|---|---|
| JP | H11232022 | 8/1999 |
| JP | H11249796 | 9/1999 |
| JP | 03146485 | 11/2008 |
| TW | M335740 | 7/2008 |

OTHER PUBLICATIONS

Halukurike et al., A Generic Mobile Palm-Mouse (2008) CS7470, Mobile and Ubiquitous Computing, College of Computing; Georgia Institute of Technology, 4 pages.

* cited by examiner

MARKING PEN

CROSS-REFERENCE TO RELATED APPLICATIONS

This application is a continuation of U.S. patent application Ser. No. 13/910,707, filed Jun. 5, 2013, which issued on Aug. 2, 2017 as U.S. Pat. No. 9,403,399, which claims the benefit of U.S. Provisional Patent Application No. 61/656,105, filed Jun. 6, 2012. The entire contents of these documents are incorporated by reference herein

BACKGROUND

The present invention relates to pens, and more particularly to a combination pen and stylus.

Pens can be used to write on a surface, typically using ink. Pens typically include a writing tip and a cap that covers the writing tip when not in use. Different types of writing tips include ballpoint, fountain, marking, and rollerball writing tips. Styluses are another type of writing instrument and are typically used with touch screens, such as resistive touch screens and capacitive touch screens.

SUMMARY

In one embodiment, the invention provides a marking pen including a body including a pen, and a cap removably coupled to the body to cover the pen. The cap includes a cap body having a length, a width, an aperture that receives the pen to cover the pen, a longitudinal axis that extends centrally through the aperture and parallel to the length, and a transverse axis that extends through the longitudinal axis normal to the longitudinal axis and parallel to the width. The pen is movable into and out of the aperture along the longitudinal axis. The cap further includes a clip including a first leg that extends from the cap body and away from the cap body in a first direction that is along the transverse axis of the cap body, a second leg that extends from the first leg and away from the first leg in a second direction such that the second leg is spaced a distance from the cap body in the first direction to create a gap between the second leg and the cap body, and a third leg that extends from the second leg in a third direction along the longitudinal axis of the cap body and along a majority of the length of the cap body and the third leg also extends toward the cap body along the transverse axis of the cap body. The clip is configured to attach the cap to an article of clothing in the gap between the second leg and the cap body.

In another embodiment the invention provides a marking pen including a cylindrical body including a first end, a second end, a longitudinal axis that extends centrally through the cylindrical body and through the first end and the second end, and a pen adjacent the first end. The marking pen further includes a fin that extends from the cylindrical body between the first end and the second end, and a cap removably coupled to the first end of the body to cover the pen. The cylindrical body is generally cylindrical from the first end to the second end and the fin is configured to inhibit rolling of the cylindrical body along a flat surface.

In another embodiment, the invention provides a marking pen including a body including a first end, a second end opposite the first end, a longitudinal axis that extends centrally through the cylindrical body and through the first end and the second end, and a pen adjacent the first end. The marking pen further includes a cap removably coupled to the first end of the body to cover the pen, and a capacitive stylus adjacent the second end of the cylindrical body.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
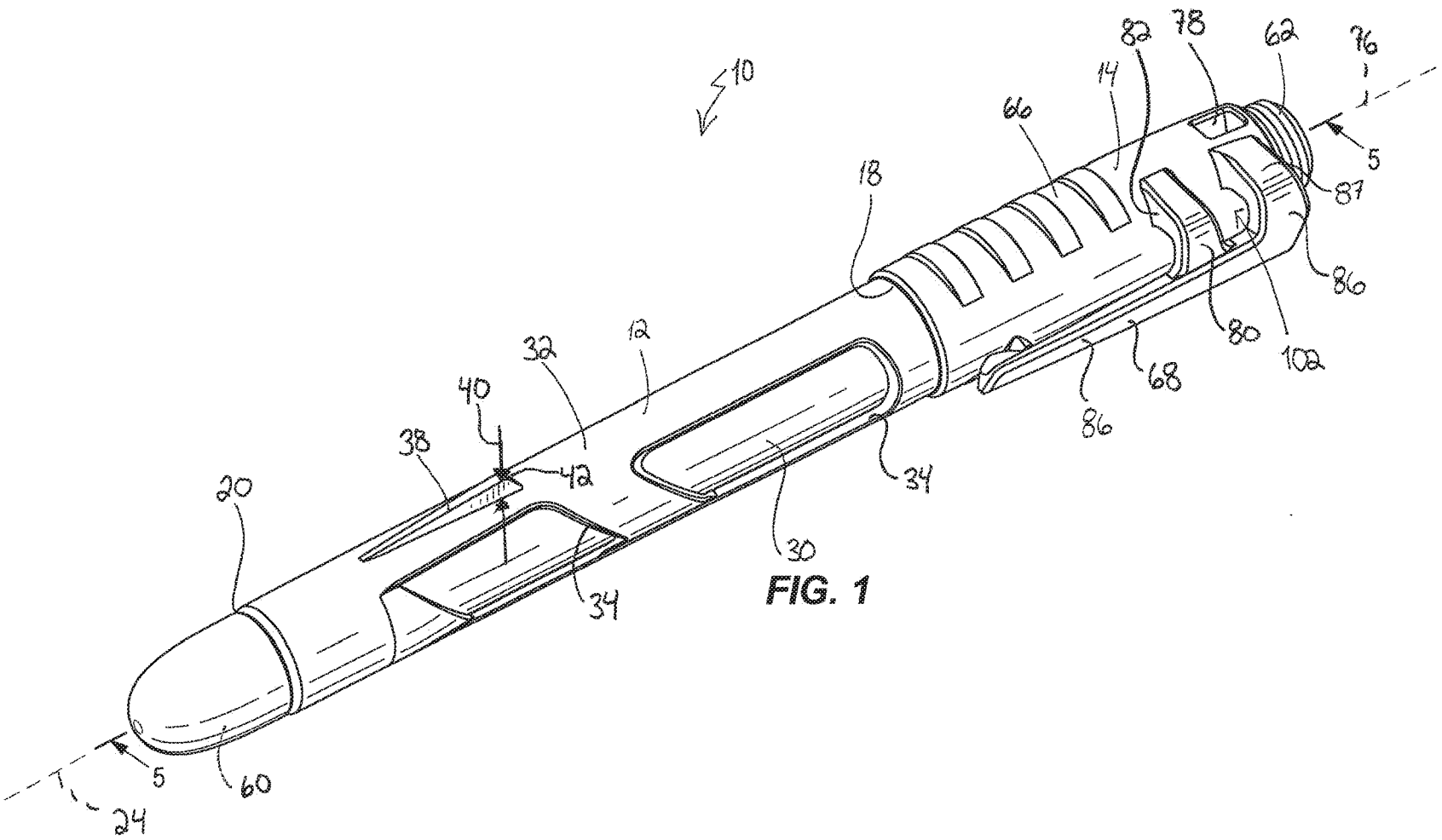
FIG. 1 is a perspective view of a marking pen according to an embodiment of the invention.
Figure 2:
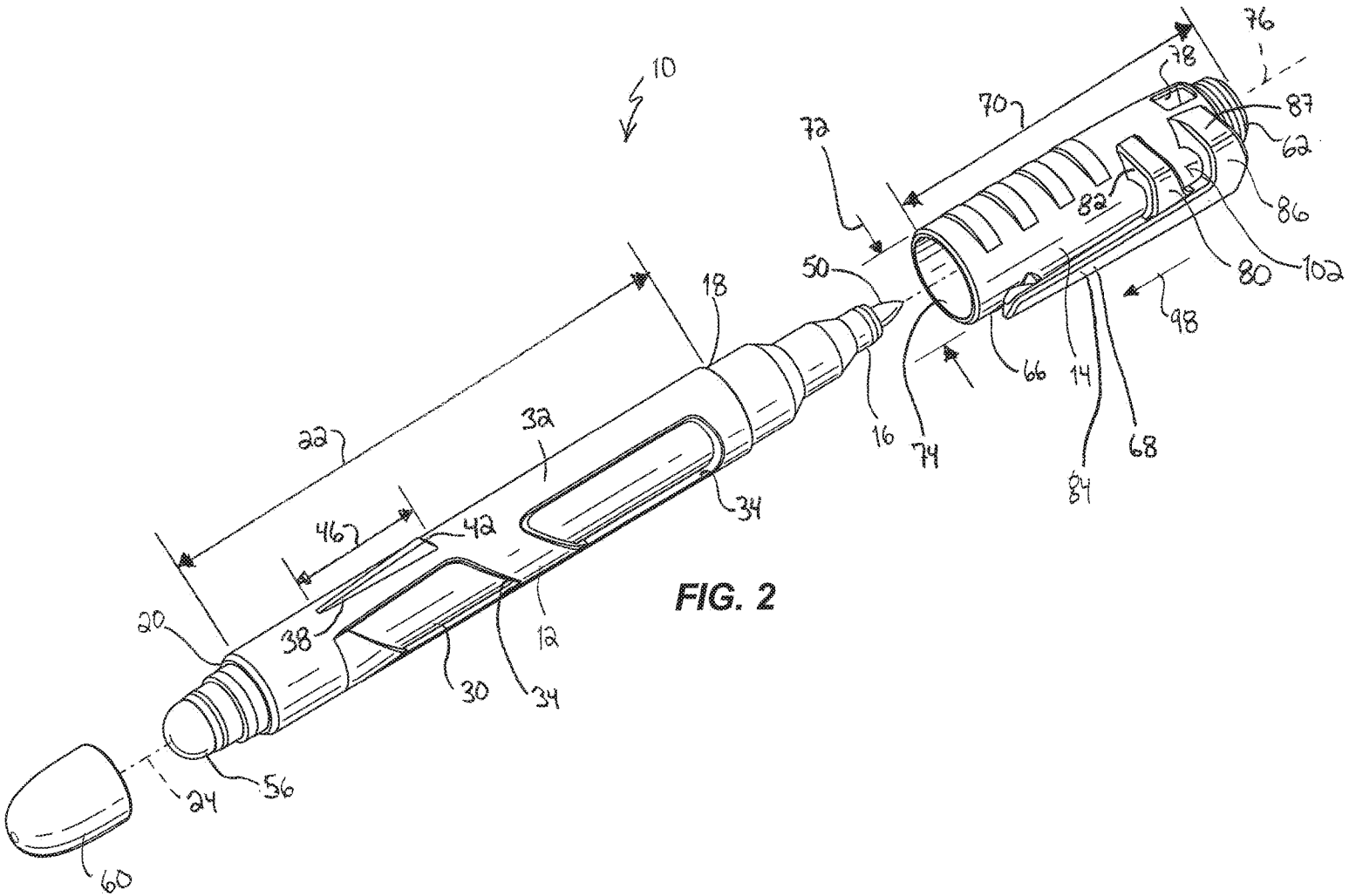
FIG. 2 is a partially exploded view of the marking pen of FIG. 1.

FIGS. 1 and 2 illustrate a marking pen 10, which in one embodiment, is particularly suited for use by a construction worker. The marking pen 10 includes a body 12, a cap 14, and a pen 16 (FIG. 2). The body 12 has a first end 18, a second end 20, and a length 22 that extends from the first end 18 to the second end 20 as illustrated in FIG. 2. The body 12 further defines a longitudinal axis 24 that extends centrally through the body 12 and through the first end 18 and the second end 20.

Figure 5:
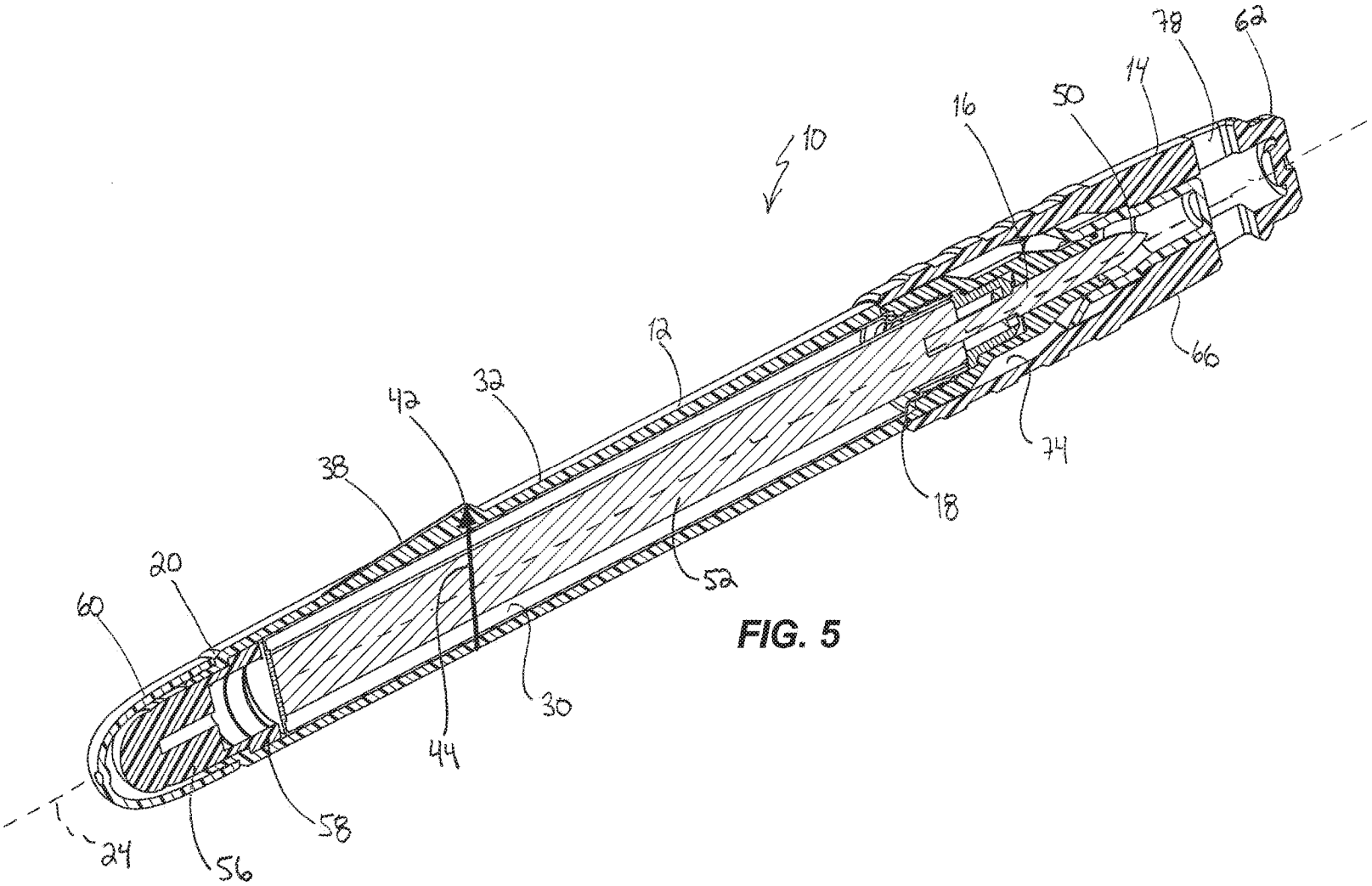
FIG. 5 is a cross-sectional view of the marking pen of FIG. 1 taken along lines 5-5 of FIG. 1.

Referring to FIGS. 2 and 5, the body 12 is generally cylindrical and the body 12 includes a first body portion 30 formed of metal and a second body portion 32 formed of plastic. The first body portion 30 is cylindrical and hollow. The second body portion 32 surrounds the first body portion 30 and is generally cylindrical. In one embodiment, the second body portion 32 is molded around the first body portion 30. The second body portion 32 includes windows or openings 34 that expose portions of the underlying first body portion 30.

With continued reference to FIGS. 2 and 5, a fin 38 extends from the cylindrical body 12 between the first end 18 and the second end 20. The fin 38 has a height 40 (FIG. 1) measured from the body 12 and normal to the longitudinal axis 24. In the illustrated embodiment, the height 40 of the fin 38 gradually increases in a direction from the second end 20 of the body 12 toward the first end 18 of the body 12. The maximum height 40 of the fin 38 defines a tip 42 of the fin 38. The tip 42 of the fin 38 defines a maximum diameter 44 of the body 12 measured normal to the longitudinal axis 24 as illustrated in FIG. 5. The fin 38 also has a length 46 that is measured parallel to the longitudinal axis 24. In the illustrated embodiment, the length 46 of the fin 38 is about one-fourth the length 22 of the body 12. In other embodiments, the length 46 is less than about one-third of the length 22 of the body 12. In the illustrated embodiment, the fin 38 is integrally formed with the second body portion 32 as a single component. For example, the fin 38 is molded as part of the second body portion 32. In other embodiments, the fin 38 can be part of the first body portion 30. In operation, the fin 38 stops the generally cylindrical body 12 from rolling on a flat work surface, such as a desktop, a workbench, and the like. The fin 38 is particularly helpful in stopping the body 12 from rolling on the work surface when the cap 14 is removed.

Referring to FIGS. 2 and 5, the pen 16 includes a marking tip 50 and an ink supply 52. The ink supply 52 is located within the hollow first body portion 30. The marking tip 50 extends through the first body portion 30 and in one embodiment the marking tip 50 includes a medium weight felt marker. In the illustrated embodiment, the pen 16 is a marker pen and more specifically an indelible marker pen. In other embodiments, other types of marker pens, such as non-permanent or dry erase type marker pens can be utilized. In some embodiments, the pen 16 can be other types of pens, such as ballpoint, rollerball, etc. In yet other embodiments, the pen 16 can include an ink well marker. In such embodiments that use a well, the ink is stored within the body 12 and the body 12 includes a window for viewing the ink level. The marking tip 50 has a relatively narrow width, as illustrated in FIG. 2, that allows the marking tip 50 to be inserted through apertures (e.g., an aperture in a piece of Unistrut®) to mark a work-piece. The marking tip 50 is configured to mark indicia on a work-piece.

With continued reference to FIGS. 2 and 5, a capacitive stylus tip 56 extends from the second end 20 of the body 12 that allows the marking pen 10 to be used as a stylus for operating a capacitive sensing touch screen interface of an electronic device, such as a phone, tablet computer, or the like. The capacitive stylus tip 56 includes a metal base 58 that is in direct contact with the first body portion 30. Therefore, the stylus 56 is configured so that the user can operate the touch screen when holding the marking pen 10 while wearing a glove and/or when the body 12 is made from a non-conductive material, such as the second body portion 32. A glove, which insulates the stylus 56 from the user's body or the non-conductive body second body portion 32 may not provide enough conductive material for the stylus 56 to operate the touch screen. However, the metal body 30 provides enough conductive material so that the user can use the capacitive stylus 56 while wearing a glove or touching only the second body portion 32. In one embodiment, the stylus 56 is formed from a piece of conductive fabric wrapped over a silicon like cylinder that deforms under pressure to mimic a user's fingertip and the conductive fabric is in direct contact with the metal base 58 of the stylus 56. One example of the conductive fabric is silver plated nylon known as MedTex180. The marking pen 10 further includes a stylus cap 60 that is removeably coupled to the second end 20 of the body 12 to protect the stylus 56 when not in use. When the cap 60 is removed from the second end 20 it can be attached to a receptacle 62 on the cap 14. Accordingly, the capacitive stylus tip 56 allows a user to use the marking pen 10 to operate a phone, including phones that include a capacitive sensing touch screen, when the user is wearing a glove, such as a leather work glove or when the user is only touching the second body portion 32.

In the illustrated embodiment, the capacitive stylus 56 is directly coupled to the first body portion 30 by the second body portion 32. More specifically, the second body portion 32 is molded around the metal base of the stylus 56 and the first body portion 30 so that the second body portion 32 surrounds part of the stylus 56 to attach the stylus 56 to the first body portion 30. In other embodiments, the stylus 56 can be attached to the first body portion 30 using a threaded connection.

Figure 3:
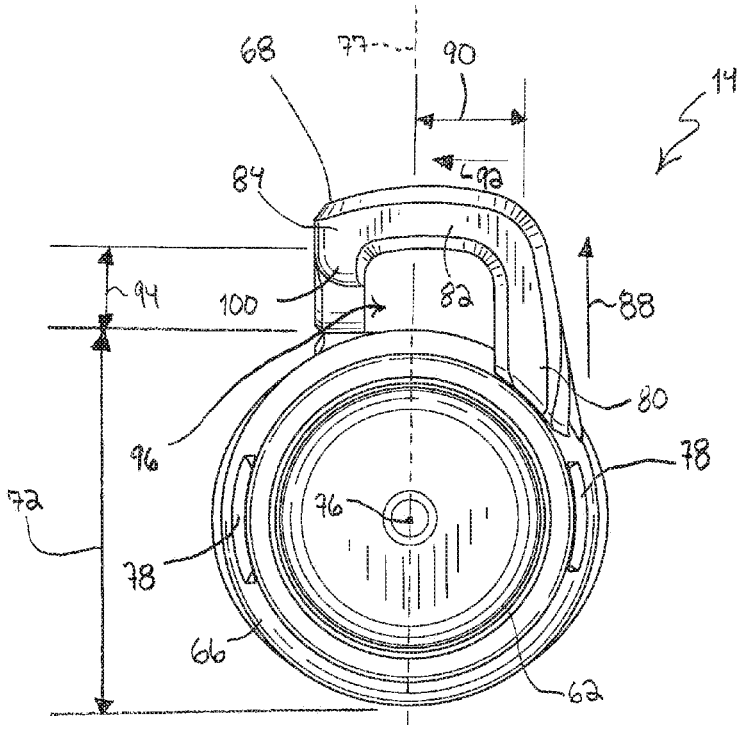
FIG. 3 is an end view of the marking pen of FIG. 1.
Figure 4:
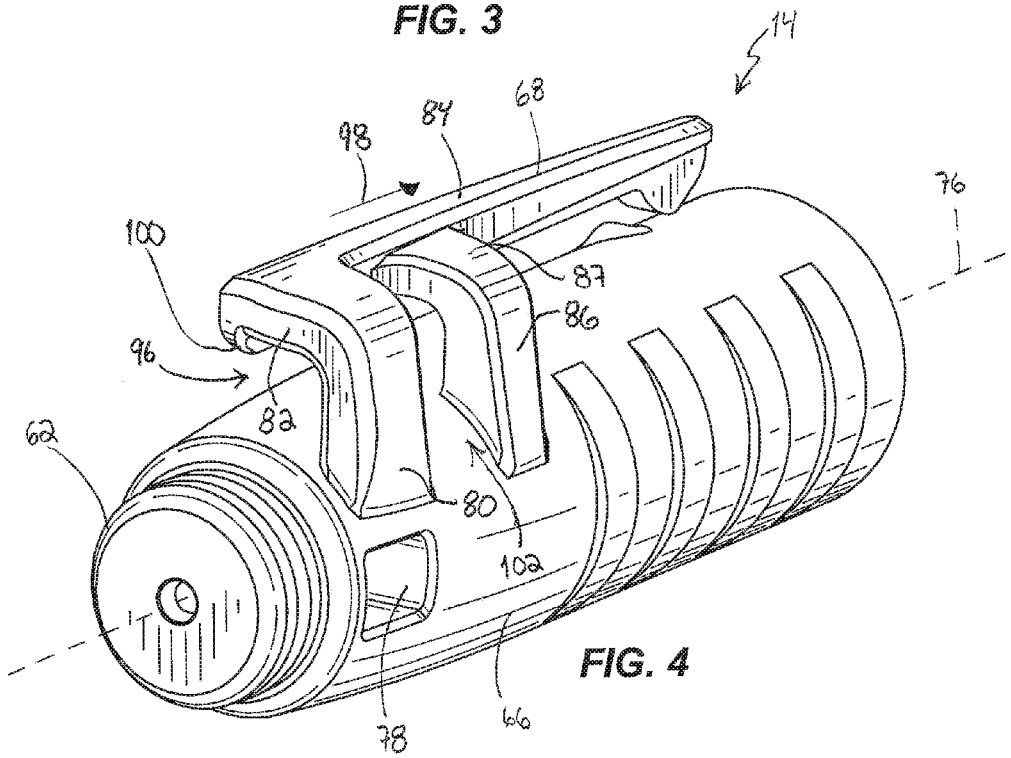
FIG. 4 is a perspective view of a cap of the marking pen of FIG. 1.

Referring to FIGS. 2-4, the cap 14 includes a cap body 66 and a clip 68. The cap 14 is removeably coupled to the first end 18 of the body 12 to protect the marking tip 50. The cap body 66 has a length 70 and a width 72 measured normal to the length 70, as illustrated in FIG. 2. The cap body 66 further includes an aperture 74, which is a blind hole that receives the first end 18 of the body 12 to couple the cap 14 to the body 12. A longitudinal axis 76 extends centrally through the aperture 74 and parallel to the length 70. A transverse axis 77 extends through the longitudinal axis 76 normal to the longitudinal axis 76 and parallel to the width 72 as illustrated in FIG. 2. The marking tip 50 is movable into and out of the aperture 74 along the axis 76. The cap body 66 further includes a lanyard aperture 78. The lanyard aperture 78 extends all the way through the cap body 66 normal to the longitudinal axis 76 and the transverse axis 77 and the axes 76, 77 pass through the aperture 78. A lanyard, such as a string or the like, can be passed through the lanyard aperture 78 to attach the cap 14 and the marking pen 10 to a user.

Referring to FIGS. 3 and 4, the clip 68 includes a first leg 80, a second leg 82, a third leg 84, a fourth leg 86, and a fifth leg 87. The first leg 80 extends from the cap body 66 and away from the cap body 66 in the direction of arrow 88, which is along the transverse axis 77 of the cap body 66 and parallel to the transverse axis 77 in the illustrated embodiment. The first leg 80 is offset from the longitudinal axis 76 of the cap body 66 an offset distance 90 that is perpendicular to the transverse axis 77. The offset distance 90 is such that the outside of the first leg 80 is approximately tangent to the outside of the cap body 66. The second leg 82 extends from the first leg 80 and away from the first leg 80 in the direction of arrow 92, which is normal to the direction 88 in the illustrated embodiment. The second leg 82 extends away from the first leg 80 such that the second leg 82 is spaced a distance 94 from the cap body 66 in the direction of arrow 88 to create a gap 96 between the second leg 82 and the cap body 66. The third leg 84, which partially defines the gap 96, extends from the second leg 82 in the direction of arrow 98, which is along the longitudinal axis 76 of the cap body 66 and parallel to the axis 76 in the illustrated embodiment. The third leg 84 extends along a majority of the length 70 of the cap body 66. A portion 100 of the third leg 84 extends opposite the direction of arrow 88 and back toward the cap body 66. The fourth leg 86 extends from the cap body 66 and away from the cap body 66 in the direction of arrow 88 and parallel to the first leg 80. The first leg 80 and the fourth leg 86 are spaced to define a gap 102 between the first leg 80 and the fourth leg 86. The fifth leg 87 extends from the fourth leg 86, normal to the fourth leg 86, and interconnects the fourth leg 86 and the third leg 84.

In operation, the clip 68 is particularly well suited for attaching the marking pen 10 to an article of clothing of the user, such as a hardhat, tool belt, shirt pocket, etc. For example, a brim of a user's hardhat can be placed in the gap 96 and the flexible clip 68 attaches the marking pen 10 to the user's hardhat. Also, a fastener, such as a cable tie, can be inserted through the gap 102 and the cable tie can be used to attach the cap 14 (and pen 10) to the user's tool belt, hardhat, etc.

Figure 6:
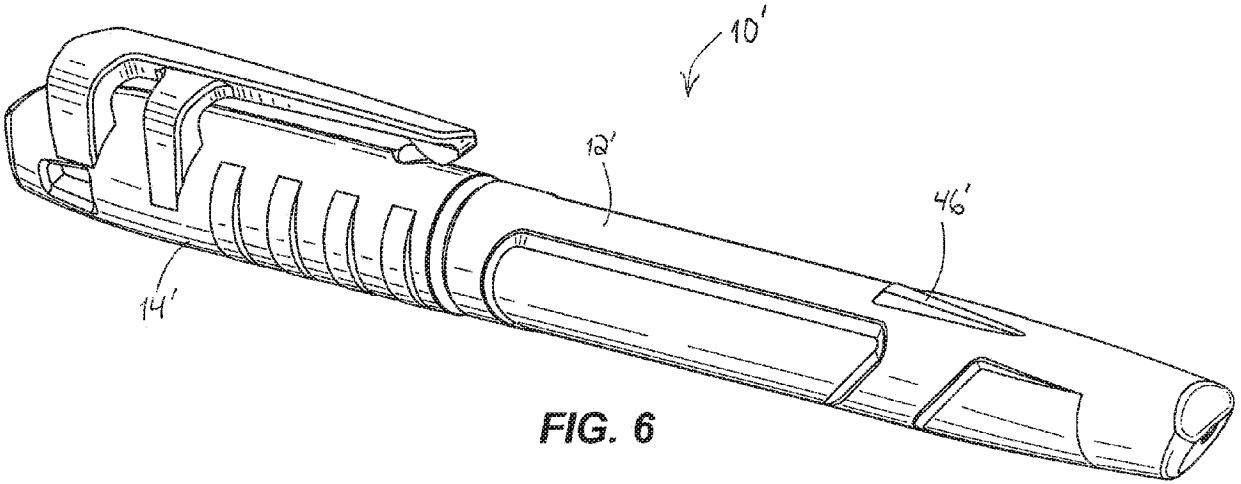
FIG. 6 is a perspective view of a marking pen according to another embodiment of the invention.

FIG. 6 illustrates a marking pen 10' according to another embodiment. The marking pen 10' includes features similar to the marking pen 10 of FIGS. 1-5 discussed above and only difference between the pens 10' and 10 will be discussed and like components have been given like reference numbers with the addition of a prime (') symbol. The marking pen 10' does not include a stylus. Cap 14' of the pen 10' is the same as the cap 14 of the pen 10. However, the pen 10' does not include the second body portion 32. Rather, body 12' of the pen 10' is formed from metal and fin 46' is integrally formed with the metal body 12' as a single component.

Figure 7:
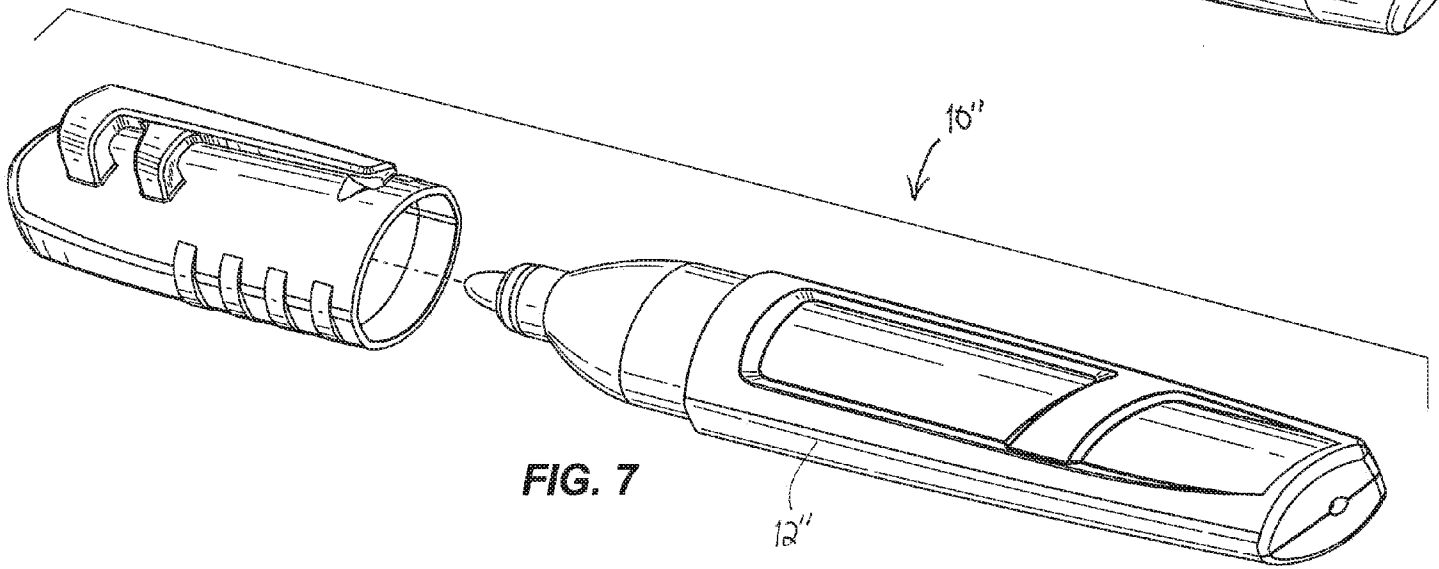
FIG. 7 is a partially exploded view of a marking pen according to yet another embodiment of the invention.

FIG. 7 illustrates a marking pen 10" according to another embodiment. The marking pen 10" includes features similar to the marking pens 10 and 10' discussed above and only differences between the pens 10, 10', and 10" will be discussed and like components have been given like reference numbers with the addition of a double prime (") symbol. The marking pen 10" includes a metal body 12" that is oblong or not generally cylindrical. Therefore, the body 12" will not roll on a flat work surface, such as a desktop, a workbench, and the like.

Thus, the invention provides, among other things, a marking pen that is particularly suited for use by a construction worker.

What is claimed is:

1. A marking pen comprising:

a body including a first end, a second end, a longitudinal axis that extends centrally through the body and through the first end and the second end, and a pen adjacent the first end, the body is generally cylindrical from the first end to the second end; and a fin that extends from the body between the first end and the second end, the fin is integrally formed with the body and has a height measured normal to the longitudinal axis, the height of the fin gradually increases in a direction from the second end toward the first end such that the fin includes a tip defining a maximum height of the fin, the fin is completely filled in with material between the tip and the body.

2. The marking pen of claim 1, wherein the tip of the fin defines a maximum diameter of the body measured normal to the longitudinal axis.

3. The marking pen of claim 1, wherein the fin includes a length measured parallel to the longitudinal axis of the body, wherein the body includes a length measured parallel to the longitudinal axis, and wherein the length of the fin is less than one-third of the length of the body.

4. The marking pen of claim 1, further comprising a capacitive stylus adjacent the second end of the body.

5. The marking pen of claim 1, wherein the body includes a metal body and a plastic outer body that surrounds the metal body, and wherein the fin is integrally formed with the plastic outer body as a single component.

6. The marking pen of claim 1, further comprising a cap including a cavity and being removably coupled to the first end of the body to cover the pen, wherein the cavity receives the first end of the body.

7. The marking pen of claim 1, wherein the maximum height of the fin is substantially less than a thickness of the pen.

8. A marking pen comprising:

a body including a first end, a second end, a longitudinal axis that extends centrally through the body and through the first end and the second end, and a pen adjacent the first end;

a fin that extends from the body between the first end and the second end; a height of the fin gradually increasing in a direction from the second end toward the first end such that the fin includes a tip defining a maximum height of the fin wherein the fin is completely filled in with material between the tip and the body; and a cap including a cavity and being removably coupled to the first end of the body to cover the pen, where the cavity receives the first end of the body, wherein the body is generally cylindrical from the first end to the second end and the fin is configured to inhibit rolling of the body along a flat surface.

9. The marking pen of claim 8, wherein the fin includes a length measured parallel to the longitudinal axis of the body, wherein the body includes a length measured parallel to the longitudinal axis, and wherein the length of the fin is less than one-third of the length of the body.

10. The marking pen of claim 8, further comprising a capacitive stylus adjacent the second end of the body.

11. The marking pen of claim 8, wherein the tip, defines a maximum diameter of the body measured normal to the longitudinal axis of the body.

12. The marking pen of claim 8, wherein the body includes a metal body and a plastic outer body that surrounds the metal body, and wherein the fin is integrally formed with the plastic outer body as a single component.

13. The marking pen of claim 8, wherein the fin has a height measured normal to the longitudinal axis and the height of the fin gradually increases to a maximum height, the maximum height of the fin is substantially less than a thickness of the pen.

* * * * *